US011731256B2

(12) United States Patent
Yamada et al.

(10) Patent No.: US 11,731,256 B2
(45) Date of Patent: Aug. 22, 2023

(54) ELECTRIC TOOL

(71) Applicant: Koki Holdings Co., Ltd., Tokyo (JP)

(72) Inventors: Hideki Yamada, Ibaraki (JP); Hideyuki Hashimoto, Ibaraki (JP); Yuta Noguchi, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 106 days.

(21) Appl. No.: 16/637,279

(22) PCT Filed: Aug. 31, 2018

(86) PCT No.: PCT/JP2018/032393
§ 371 (c)(1),
(2) Date: Feb. 7, 2020

(87) PCT Pub. No.: WO2019/065087
PCT Pub. Date: Apr. 4, 2019

(65) Prior Publication Data

US 2020/0246954 A1 Aug. 6, 2020

(30) Foreign Application Priority Data

Sep. 29, 2017 (JP) ..... 2017-191587

(51) Int. Cl.
*B25D 16/00* (2006.01)
*B25D 17/00* (2006.01)

(52) U.S. Cl.
CPC ..... *B25D 16/006* (2013.01); *B25D 17/00* (2013.01); *B25D 2216/0084* (2013.01);
(Continued)

(58) Field of Classification Search
CPC ..... B25D 16/006; B25D 17/00; B25D 2216/0084; B25D 2250/201; B25D 2250/221; B25D 2250/265
See application file for complete search history.

(56) References Cited

U.S. PATENT DOCUMENTS 8,552,669 B2 * 10/2013 Kusakawa ..... H02P 7/29 388/811
9,314,855 B2 * 4/2016 Ookubo ..... H02P 23/03
(Continued)

FOREIGN PATENT DOCUMENTS

CN 1891408 1/2007
CN 102300677 12/2011
(Continued)

OTHER PUBLICATIONS

"Office Action of German Counterpart Application", dated Sep. 7, 2020, with English translation thereof, pp. 1-14.
(Continued)

*Primary Examiner* — Thomas M Wittenschlaeger
*Assistant Examiner* — David G Shutty
(74) *Attorney, Agent, or Firm* — JCIPRNET

(57) ABSTRACT

Provided is an electric tool with which work efficiency can be improved. A controller of an electric tool can execute: a first control, whereby during a non-operating state after a motor has started up and before a tip tool is set to be in an operating state, the motor is driven at a slow idling rotation speed, and when the tip tool is set to be in the operating state, the motor is driven at a normal rotation speed which is higher than the slow idling rotation speed; and a second control, whereby in a case where a trigger switch has been turned off in a state where the motor is being driven at the normal rotation speed and the trigger switch is thereafter turned on again under a prescribed condition, the motor is driven at the normal rotation speed regardless of the state of the tip tool.

13 Claims, 6 Drawing Sheets

(52) U.S. Cl.
CPC .. *B25D 2250/095* (2013.01); *B25D 2250/201* (2013.01); *B25D 2250/221* (2013.01); *B25D 2250/265* (2013.01)

(56) References Cited

U.S. PATENT DOCUMENTS

| | | | | |
|---|---|---|---|---|
| 10,549,396 | B2 * | 2/2020 | Matsunaga | H02P 7/245 |
| 11,059,156 | B2 * | 7/2021 | Abe | B25D 17/24 |
| 2013/0186661 | A1 * | 7/2013 | Okubo | B25F 5/00 173/2 |
| 2015/0340974 | A1 * | 11/2015 | Usselman | H02P 3/18 318/245 |
| 2016/0121509 | A1 * | 5/2016 | Kuragano | B27B 9/00 30/377 |
| 2016/0129576 | A1 * | 5/2016 | Nishikawa | B25D 11/00 173/2 |

FOREIGN PATENT DOCUMENTS

| | | | | |
|---|---|---|---|---|
| CN | 103459097 | | 12/2013 | |
| CN | 103561913 | | 2/2014 | |
| CN | 107148326 | | 9/2017 | |
| DE | 10358571 | | 7/2005 | |
| DE | 112012006280 | | 2/2015 | |
| EP | 2295206 | | 3/2011 | |
| JP | 2008296323 | | 12/2008 | |
| JP | 2010173053 | | 8/2010 | |
| JP | 2012081561 | | 4/2012 | |
| JP | 2015035843 | | 2/2015 | |
| JP | 2016010843 | | 1/2016 | |
| JP | 2016010843 | A * | 1/2016 | B25F 5/00 |
| JP | 201668230 | A * | 5/2016 | B25D 16/00 |
| JP | 2016068230 | | 5/2016 | |
| JP | 2016068230 | A * | 5/2016 | B25D 16/00 |
| JP | 2016124061 | | 7/2016 | |
| JP | 2016124061 | A * | 7/2016 | B25F 5/00 |
| WO | 2016121458 | | 8/2016 | |

OTHER PUBLICATIONS

"International Search Report (Form PCT/ISA/210) of PCT/JP2018/032393", dated Nov. 13, 2018, with English translation thereof, pp. 1-4.

"Opposition to German Counterpart Application", dated Apr. 25, 2022, with English translation thereof, p. 1-p. 30.

"Office Action of China Counterpart Application", dated Jun. 6, 2022, with English translation thereof, p. 1-p. 17.

"Office Action of China Counterpart Application", dated Feb. 24, 2023, with English translation thereof, pp. 1-7.

"Summons to Oral Proceedings of German Counterpart Application", issued on Apr. 11, 2023, with English translation tereof, pp. 1-24.

* cited by examiner

1A ELECTRIC TOOL

ELECTRIC TOOL

CROSS-REFERENCE TO RELATED APPLICATION

This application is a 371 application of the International PCT application serial no. PCT/JP2018/032393, filed on Aug. 31, 2018, which claims the priority benefits of Japan application no. 2017-191587, filed on Sep. 29, 2017. The entirety of each of the above-mentioned patent applications is hereby incorporated by reference herein and made a part of this specification.

BACKGROUND

Technical Field

The disclosure relates to an electric tool such as a hammer or a hammer drill.

Description of Related Art

In electric tools such as hammers and hammer drills, in order to curb unnecessary noise and vibration in an unloaded state, slow idling control of performing control such that a motor is set to be at a low rotation speed in an unloaded state and switching the motor to a necessary high rotation speed when a load is detected has become known.

CITATION LIST

Patent Literature

Patent Literature 1

Japanese Patent Laid-Open No. 2010-173053.

SUMMARY

Technical Problem

In a case where an operation (for example, chipping work using a hammer) of frequently switching between a state where a trigger switch is turned on and a motor is driven and a state where the trigger switch is turned off and the motor is not driven is performed, the efficiency of work may be reduced due to slow idling control. Specifically, when repeating an operation of temporarily turning off the trigger switch and then turning on the trigger switch again, control of temporarily driving the motor at a low rotation speed, and then increasing the rotation speed of the motor to a high rotation speed after detecting a load is performed, which results in a problem that a time lag from when the trigger switch is turned on again to when the rotation speed of the motor reaches a high rotation speed (an actual work rotation speed) is increased, and the efficiency of work is reduced.

The disclosure has been made in view of such a situation, and it is to provide an electric tool which is capable of increasing the efficiency of work.

Solution to Problem

An aspect of the disclosure is an electric tool. The electric tool includes a motor, a tip tool which is driven by the motor, an operation unit which is operated by an operator, and a control unit which drives the motor when the operation unit is operated, wherein the control unit is capable of executing a first control and a second control, the first control is to drive the motor at a first rotation speed in a non-operating state after an operation with the operation unit is started and before the tip tool is set to be in an operating state and to drive the motor at a second rotation speed higher than the first rotation speed when the tip tool is set to be in the operating state, and the second control is to drive the motor at the second rotation speed regardless of a state of the tip tool in a case where the operation unit is operated again under a predetermined condition after the operation for the operation unit is released in a state where the motor is driven at the second rotation speed.

The electric tool may further include a detection unit which detects a load to be applied to the motor, wherein the control unit may determine that the tip tool is in the non-operating state when the load detected by the detection unit is less than a first setting value and determine that the tip tool is in the operating state when the load is equal to or greater than the first setting value.

The predetermined condition may be a condition that a rotation speed of the motor is not equal to or less than a predetermined rotation speed.

The predetermined condition may be a condition that a predetermined period of time has not elapsed since the operation is released.

The predetermined condition may be a condition that it is after the operation is released in a state where a load to be applied to the motor is equal to or greater than a second setting value.

The predetermined condition may be a condition that it is after the operation with the operation unit and the operation released are repeated.

When the motor is driven at the second rotation speed, the control unit may drive the motor at the second rotation speed for at least a predetermined period of time even when the tip tool is set to be in the non-operating state.

The electric tool may further include a movement transmission mechanism which is capable of transmitting a rotating force and a striking force to the tip tool through a driving force of the motor, and a switching mechanism which switches to drive the tip tool in any mode of a plurality of modes including at least a striking mode and a rotation striking mode.

The control unit may execute the second control only when the switching mechanism selects the striking mode.

The control unit may drive the motor at the first rotation speed in a case where the operation unit is operated again when a mode selected is switched by the switching mechanism before the motor is stopped after the operation is released.

The operation unit may be a trigger switch.

The motor may be a brushless motor.

Meanwhile, any combinations of the above-described components and the expressions of the disclosure which are converted between methods, systems, and the like are also effective as aspects of the disclosure.

Advantageous Effects of Invention

According to the disclosure, an electric tool capable of increasing the efficiency of work is provided.

DESCRIPTION OF EMBODIMENTS

Figure 1:
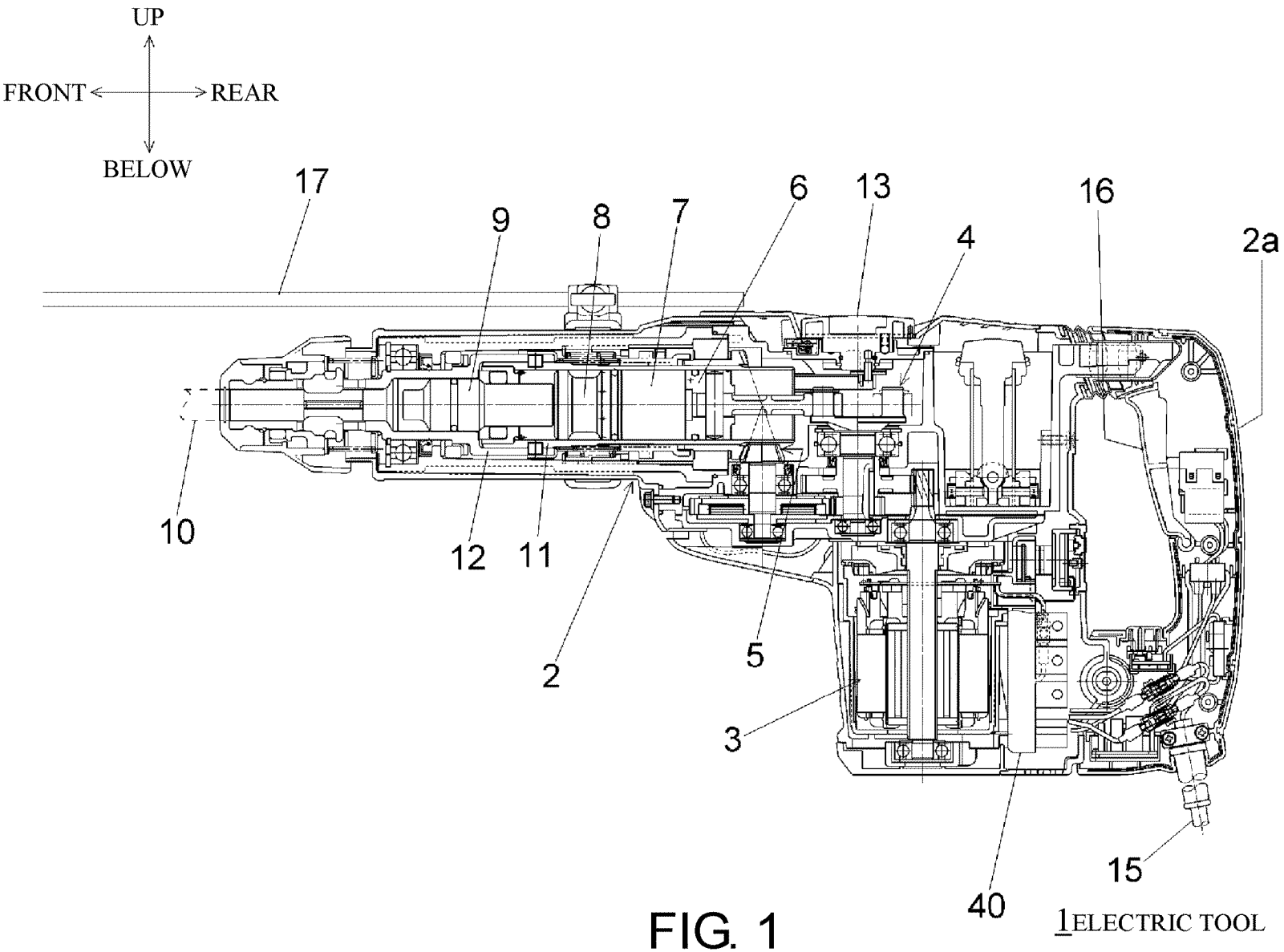
FIG. 1 is a side cross-sectional view of an electric tool according to an embodiment of the disclosure.

Hereinafter, preferred embodiments of the disclosure will be described in detail with reference to the accompanying drawings. Meanwhile, the same or equivalent components, members, processes, and the like shown in the drawings will be denoted by the same reference numerals and signs, and repeated description thereof will be omitted as appropriate. In addition, the embodiments do not limit the invention but are examples, and all features and combinations thereof described in the embodiments are not necessarily essential to the invention.

FIG. 1 is a side cross-sectional view of an electric tool 1 according to an embodiment of the disclosure. A front-back direction and a vertical direction will be defined using FIG. 1. The electric tool 1 is a hammer drill (hammering machine), and it is possible to perform chipping operation, drilling operation, and crushing operation on material to be cut such as concrete and stone by applying a rotating force and a striking force to a tip tool 10. In the electric tool 1, a configuration from the rotation of a motor 3 to the rotation and strike of the tip tool 10 is well known, and thus only a brief description will be given below.

The electric tool 1 is AC-driven here, and a power cord 15 for connection to an external AC power supply extends from a rear end lower portion (a lower end portion of a handle portion 2*a*) of a housing 2. The rear portion of the housing 2 is the handle portion 2*a*, and the handle portion 2*a* is provided with a trigger switch 16 which is an operation unit for a user to switch between driving and stopping of the motor 3. The motor 3, a movement conversion mechanism 4 and a rotation transmission mechanism 5 constituting a movement transmission mechanism, a cylinder 11, and a retainer sleeve (tool holding portion) 12 are held in the housing 2. The cylinder 11 and the retainer sleeve 12 are rotatable with respect to the housing 2 with a front-back direction as an axis. In the cylinder 11 and the retainer sleeve 12, a piston 6, a striker 8, and a middle piece 9 are set to be capable of reciprocating in the front-back direction. A pressure chamber (air chamber) 7 is formed between the piston 6 and the striker 8. The tip tool 10 is detachably held at a front end portion of the retainer sleeve 12.

The motor 3 is an inner rotor type brushless motor here, and is provided on a lower portion of the housing 2. A control circuit board 40 for controlling the driving of the motor 3 is provided at the back of the motor 3 in the housing 2. The rotation of the motor 3 with the vertical direction as an axis is converted into reciprocation of the piston 6 in the front-back direction using the movement conversion mechanism 4 such as a crank mechanism. The pressure (air pressure) of the pressure chamber 7 changes (expands/compressed) due to the reciprocation of the piston 6, and the striker 8 is reciprocated back and forth. The striker 8 strikes the middle piece 9, and the middle piece 9 strikes the tip tool 10. On the other hand, the rotation of the motor 3 with the vertical direction as an axis is converted into the rotation of the cylinder 11 and the retainer sleeve 12 with the front-back direction as an axis using the rotation transmission mechanism 5 including a pair of bevel gears. The tip tool 10 is rotated together with the retainer sleeve 12. A user can switch an operation mode of the electric tool 1 between a hammer mode (striking mode) for applying a striking force without applying a rotating force to the tip tool 10 and a hammer drill mode (rotation striking mode) for applying both a rotating force and a striking force to the tip tool 10 by using a mode setting dial 13 as a switching mechanism provided on an upper portion of the housing 2. A shaft (depth gauge) 17 extending in the front-back direction above the housing 2 is a member for determining the depth of drilling by bringing a front end into contact with a work material, and is attached to the housing 2 at any position in the front-back direction.

Figure 2:
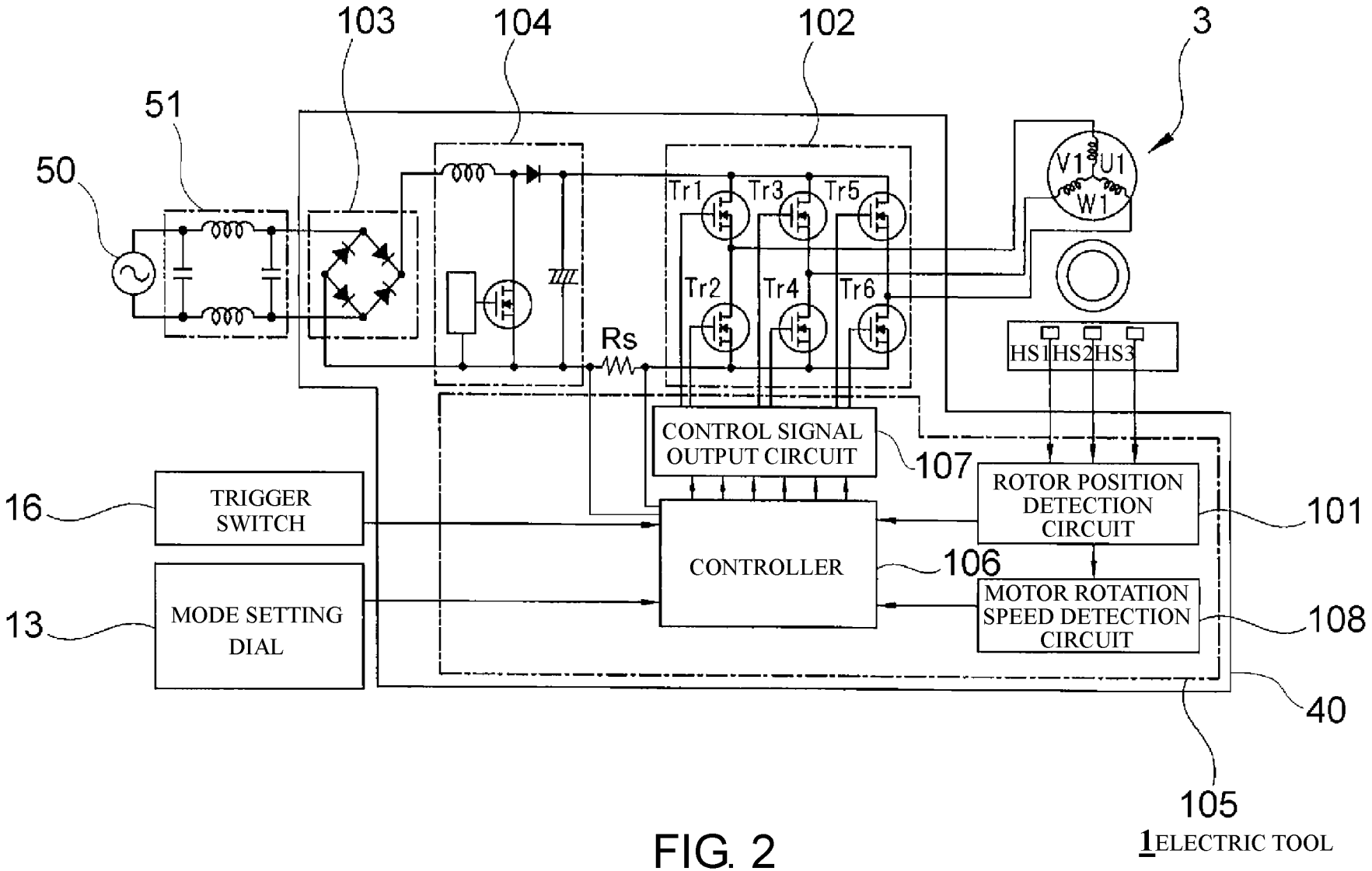
FIG. 2 is a circuit block diagram of the electric tool.

FIG. 2 is a circuit block diagram of the electric tool 1. A diode bridge 103 as a rectifier circuit is connected to an AC power supply 50 through a noise countermeasure circuit 51. An inverter circuit 102 is connected to an output side of the diode bridge 103 through a power factor improvement circuit 104. The noise countermeasure circuit 51 plays a role of preventing noise generated in the inverter circuit 102 from being transmitted to the AC power supply 50 side. The diode bridge 103 converts AC of the AC power supply 50 to DC and supplies the DC to the inverter circuit 102. The inverter circuit 102 includes switching elements Tr1 to Tr6 such as FETs or IGBTs connected in a 3-phase bridge manner, and supplies a driving current to stator coils U1, V1, and W1 of the motor 3.

The motor control unit 105 controlling the inverter circuit 102 includes a controller 106. A control signal (for example, a PWM signal) from the controller 106 is applied to a gate (control terminal) of each switching element of the inverter circuit 102 through a control signal output circuit 107. Detected signals of Hall elements HS1 to HS3 are transmitted to a rotor position detection circuit 101. Signals output from the rotor position detection circuit 101 are transmitted to the controller 106 and a motor rotation speed detection circuit 108. The motor rotation speed detection circuit 108 calculates the actual rotation speed of the motor 3. A signal output from the motor rotation speed detection circuit 108 is transmitted to the controller 106. The controller 106 includes a microprocessor that arithmetically calculates a control signal to be output to the control signal output circuit 107, a memory that stores programs, arithmetic expressions, and data used for the control of a rotation speed of the motor 3, and a timer that measures time. The controller 106 executes a control corresponding to an operation mode (a hammer mode or a hammer drill mode) based on a rotation position of the mode setting dial 13. The controller 106 detects a current (load) flowing to the motor 3 according to a voltage between both ends of a resistor Rs as a current (load) detection unit provided in a current path of the motor 3.

Figure 3:
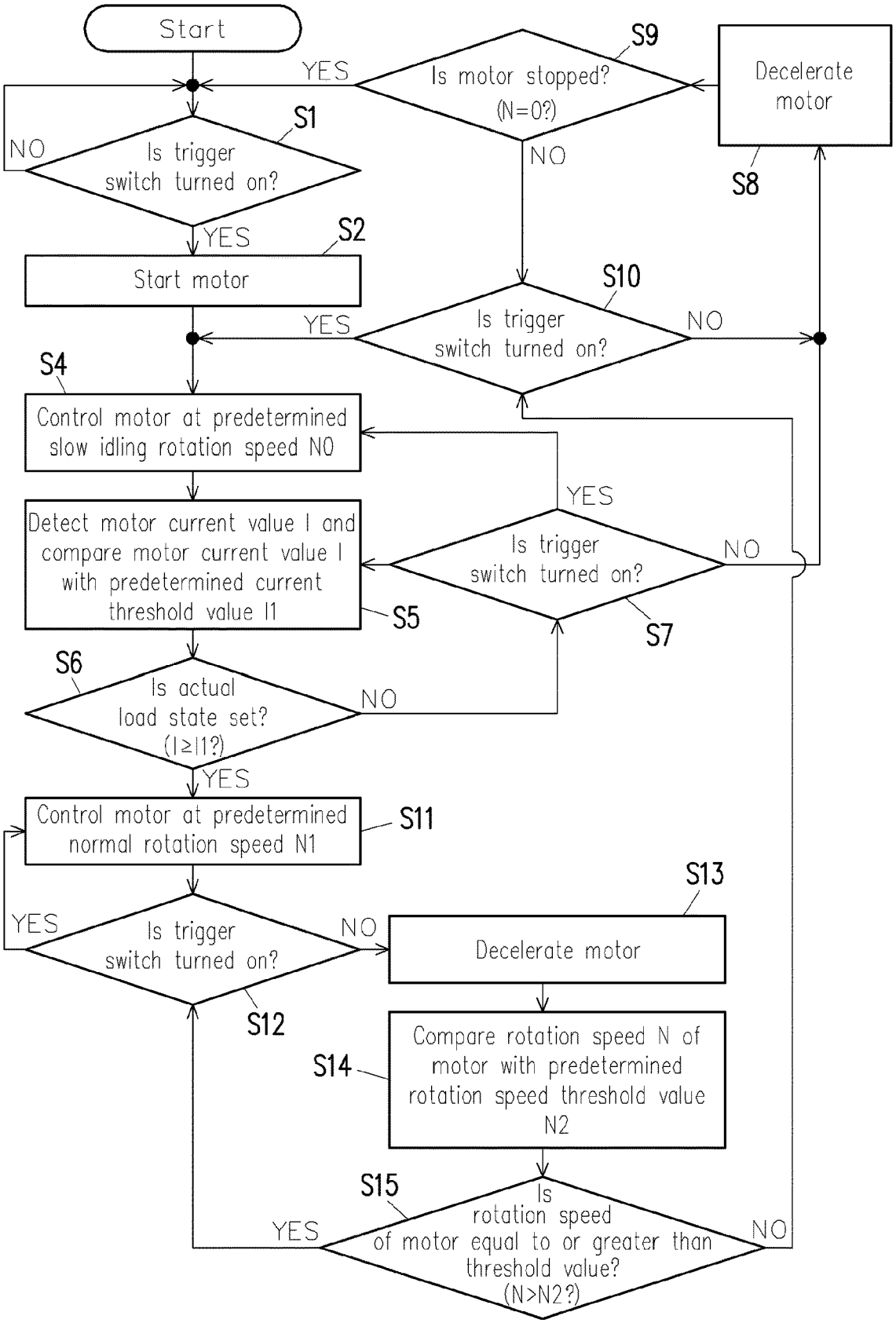
FIG. 3 is a flowchart showing a first example of control of the electric tool.

FIG. 3 is a flowchart showing a first example of control of the electric tool 1. When the trigger switch 16 is turned on (operated) (YES in S1), the controller 106 starts the motor 3 (S2) and controls the motor 3 such that the rotation speed of the motor 3 is set to be a predetermined slow idling rotation speed N0 as a first rotation speed (S4). The controller 106 detects a current (hereinafter, also referred to as a "motor current") I flowing to the motor 3 and compares the current I with a current threshold value I1 as a first setting value for determining whether or not it is an actual load state (S5).

In a case where an actual load state, that is, the relation of I≥I1, is not established (NO in S6), the controller 106 continues controlling the motor 3 such that it is at the slow idling rotation speed N0 (S4) when the trigger switch 16 is turned on (YES in S7) and decelerates the motor 3 (S8) when the trigger switch 16 is turned off (an operation is released) (NO in S7). The deceleration of the motor 3 may be natural deceleration or may be deceleration using an electrical brake, for example, by turning off the switching elements (Tr1, Tr3, and Tr5) on an upper arm side of the inverter circuit 102 and turning on the switching elements (Tr2, Tr4, and Tr6) on a lower arm side (this is the same as in S13 to be described later). In a case where the motor 3 has not stopped (NO in S9), the controller 106 continues decelerating the motor 3 (S8) as long as the trigger switch 16 is not turned on (NO in S10). When the motor 3 has stopped (YES in S9), the controller 106 returns to step S1. Before the motor 3 has stopped (NO in S9), when the trigger switch 16 is turned on (YES in S10), the controller 106 returns to controlling the motor 3 such that it is at the slow idling rotation speed N0 (S4).

When an actual load state, that is, the relation of I≥I1, is established in step S6 (YES in S6), the controller 106 controls the motor 3 such that the rotation speed of the motor 3 is set to be a predetermined normal rotation speed (actual work rotation speed) N1 as a second rotation speed (S11). When the trigger switch 16 is turned on (YES in S12), the controller 106 continues controlling the motor 3 (S11) such that it is at the normal rotation speed N1. When the trigger switch 16 is turned off (NO in S12), the controller 106 decelerates the motor 3 (S13). The controller 106 compares the rotation speed N of the motor 3 with a predetermined rotation speed threshold value N2 (S14). N2 may be zero. When the trigger switch 16 is turned on (YES in S12) in a case where N>N2 (YES in S15), the controller 106 returns to controlling the motor 3 such that it is at the normal rotation speed N1 (S11). When the trigger switch 16 is turned off (NO in S12) in a case where N>N2 (YES in S15), the controller 106 continues decelerating the motor 3 (S13). When the trigger switch 16 is turned off (NO in S10) in a case where N≤N2 (NO in S15), the controller 106 transitions to the deceleration of the motor 3 in step S8. When the trigger switch 16 is turned on (YES in S10) in a case where N≤N2 (NO in S15), the controller 106 returns to controlling the motor 3 such that it is at the slow idling rotation speed N0 (S4).

Figure 4:
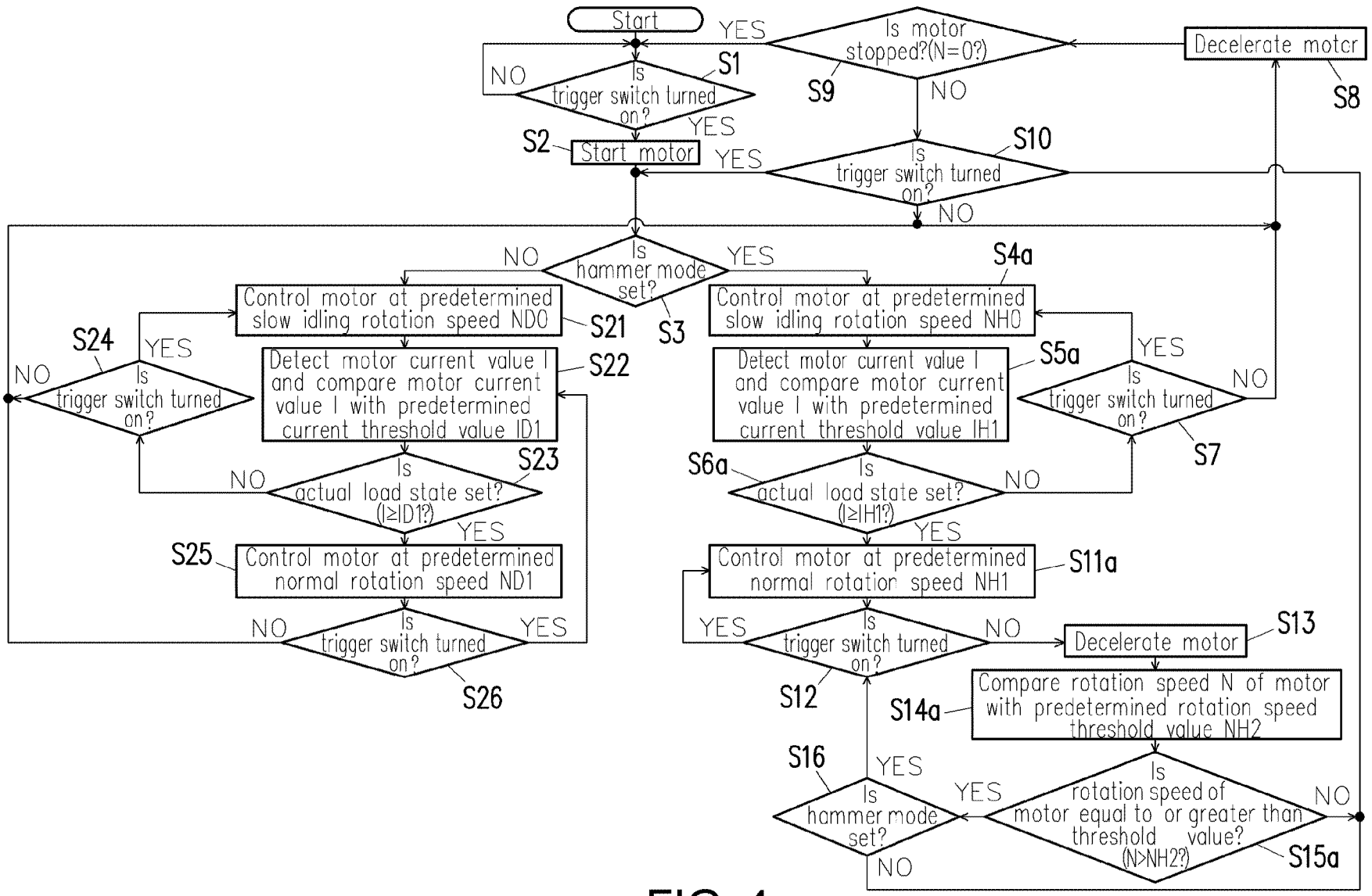
FIG. 4 is a flowchart showing a second example of control of the electric tool.

FIG. 4 is a flowchart showing a second example of control of the electric tool 1. In the flowchart shown in FIG. 4, different control is performed depending on whether it is a hammer mode or a hammer drill mode. Hereinafter, specific description will be given with an emphasis on differences from FIG. 3. After the motor 3 is started (S2), when a hammer mode is set (YES in S3), the controller 106 controls the motor 3 such that the rotation speed of the motor 3 is set to be a predetermined slow idling rotation speed NH0 as a first rotation speed (S4*a*). The controller 106 detects a motor current I and compares the motor current I with a current threshold value IH1 as a first setting value for determining whether or not it is an actual load state (S5*a*). In a case where an actual load state, that is, the relation of I≥IH1, is not established (NO in S6*a*), the controller 106 continues controlling the motor 3 (S4*a*) at the slow idling rotation speed NH0 when the trigger switch 16 is turned on (YES in S7) and decelerates the motor 3 (S8) when the trigger switch 16 is turned off (NO in S7). Before the motor 3 is stopped (NO in S9), when the trigger switch 16 is turned on (YES in S10), the controller 106 returns to the determination of a mode (S3).

When an actual load state, that is, the relation of I≥IH1, is established in step S6*a* (YES in S6*a*), the controller 106 controls the motor 3 such that the rotation speed of the motor 3 is set to be a predetermined normal rotation speed NH1 as a second rotation speed (S11*a*). When the trigger switch 16 is turned on (YES in S12), the controller 106 continues controlling the motor 3 (S11*a*) at the normal rotation speed NH1. When the trigger switch 16 is turned off (NO in S12), the controller 106 decelerates the motor 3 (S13). The controller 106 compares the rotation speed N of the motor 3 with a predetermined rotation speed threshold value NH2 (S14*a*). NH2 may be zero. When the trigger switch 16 is turned on (YES in S12) in a case where N>NH2 (YES in S15*a*) and in a hammer mode (YES in S16), the controller 106 returns to controlling the motor 3 such that it is at the normal rotation speed NH1 (S11*a*). When the trigger switch 16 is turned off (NO in S12) in a case where N>NH2 (YES in S15*a*) and in a hammer mode (YES in S16), the controller 106 continues decelerating the motor 3 (S13). The controller 106 transitions to the deceleration of the motor 3 in step S8 when the trigger switch 16 is turned off (NO in S10) in a case where N≤NH2 (NO in S15*a*) or N>NH2 (YES in S15*a*) and in a hammer drill mode (NO in S16), and the controller 106 returns to the determination of a mode (S3) when the trigger switch 16 is turned on (YES in S10).

After the motor 3 is started (S2), when a hammer drill mode is set (NO in S3), the controller 106 controls the motor 3 such that the rotation speed of the motor 3 is set to be a predetermined slow idling rotation speed ND0 (S21). ND0 may be equal to NH0. The controller 106 detects a motor current I and compares the motor current I with a current threshold value ID1 as a first setting value for determining whether or not it is an actual load state (S22). ID1 may be equal to IH1. The controller 106 continues controlling the motor 3 such that it is at the slow idling rotation speed ND0 (S21) when the trigger switch 16 is turned on (YES in S24) in a case where an actual load state, that is, the relation of I≥ID1, is not established (NO in S23), and the controller 106 decelerates the motor 3 (S8) when the trigger switch 16 is turned off (NO in S24). The controller 106 controls the motor 3 (S25) such that the rotation speed of the motor 3 is set to be a predetermined normal rotation speed ND1 when an actual load state, that is, the relation of I≥ID1, is established in step S23 (YES in S23). ND1 may be equal to NH1. The controller 106 returns to step S22 when the trigger switch 16 is turned on (YES in S26). The controller 106 transitions to the deceleration of the motor 3 in step S8 when the trigger switch 16 is turned off (NO in S26).

Figure 5:
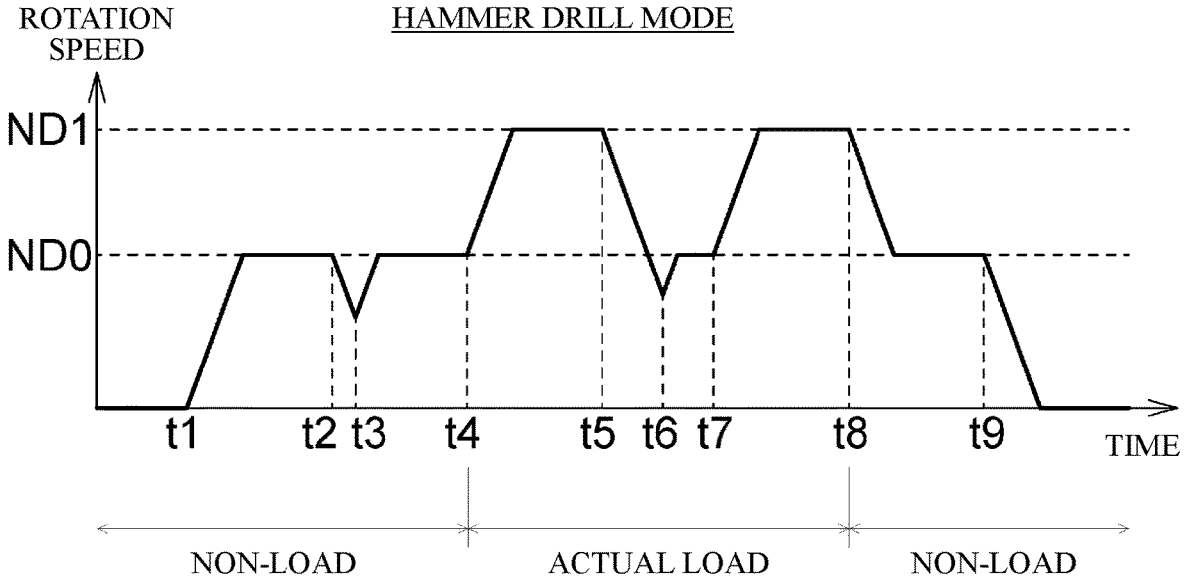
FIG. 5 is a time chart showing an example of changes in the rotation speed of a motor 3 with time in a hammer drill mode in a case where the control shown in FIG. 4 is performed.

FIG. 5 is a time chart showing an example of changes in the rotation speed of the motor 3 with time in a hammer drill mode in a case where the control shown in FIG. 4 is performed. When the trigger switch 16 is turned on at time t1, the controller 106 starts the motor 3 and drives the motor 3 at a slow idling rotation speed ND0. The controller 106 decelerates the motor 3 when the trigger switch 16 is turned off at time t2, and the controller 106 drives the motor 3 at the slow idling rotation speed ND0 again when the trigger switch 16 is turned on again at time t3 before the motor 3 is stopped. In addition, when the trigger switch 16 is turned on again, the controller 106 drives the motor 3 again at the slow idling rotation speed ND0 even when the motor 3 is stopped at time t3. When transition from a non-load state to an actual load state is performed at time t4 (when the tip tool 10 transitions from a non-operating state to an operating state), the controller 106 increases the rotation speed of the motor 3 to a normal rotation speed ND1. The controller 106 decelerates the motor 3 when the trigger switch 16 is turned off at time t5, and the controller 106 drives the motor 3 again at the slow idling rotation speed ND0 when the trigger switch 16 is turned on again at time t6 before the motor 3 is stopped. In addition, when the trigger switch 16 is turned on again, the controller 106 drives the motor 3 again at the slow idling rotation speed ND0 even when the motor 3 is stopped at time t6. When it is detected that an actual load state is set at time t7, the controller 106 increases the rotation speed of the motor 3 to the normal rotation speed ND1. A time between the time t6 and the time t7 is a time required for the controller 106 to determine whether a non-load state is set or an actual load state is set. When transition from an actual load state to a non-load state is performed at time t8 (when the tip tool 10 transitions from an operating state to a non-operating state), the controller 106 reduces the rotation speed of the motor 3 to the slow idling rotation speed ND0. When the trigger switch 16 is turned off at time t9, the controller 106 decelerates the motor 3 to stop the motor 3.

Figure 6:
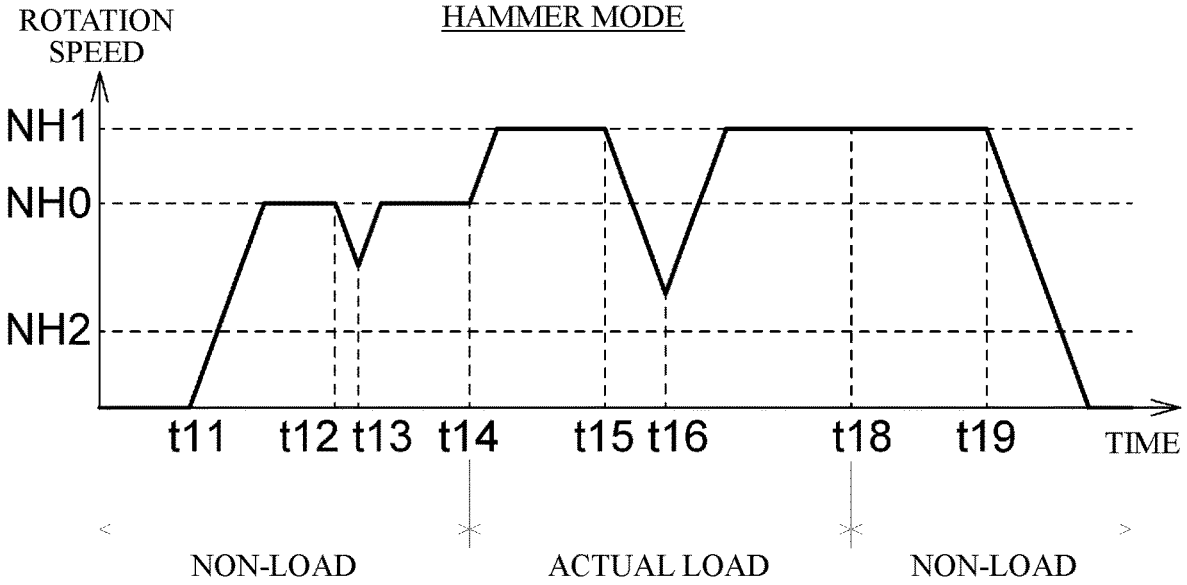
FIG. 6 is a time chart showing an example of changes in the rotation speed of the motor 3 with time in a hammer mode in a case where the control shown in FIG. 4 is performed.

FIG. 6 is a time chart showing an example of changes in the rotation speed of the motor 3 with time in a hammer mode in a case where the control shown in FIG. 4 is performed. When the trigger switch 16 is turned on at time t11, the controller 106 starts the motor 3 and drives the motor 3 at a slow idling rotation speed NH0. The controller 106 decelerates the motor 3 when the trigger switch 16 is turned off at time t12, and the controller 106 drives the motor 3 again at the slow idling rotation speed NH0 when the trigger switch 16 is turned on again at time t13 before the motor 3 is stopped. In addition, when the trigger switch 16 is turned on again, the controller 106 drives the motor 3 again at the slow idling rotation speed NH0 even when the motor 3 is stopped at time t13. When transition from a non-load state to an actual load state is performed at time t14 (when the tip tool 10 transitions from a non-operating state to an operating state), the controller 106 increases the rotation speed of the motor 3 to a normal rotation speed NH1. The controller 106 decelerates the motor 3 when the trigger switch 16 is turned off at time t15, and the controller 106 drives the motor 3 again at the normal rotation speed NH1 when the trigger switch 16 is turned on again at time t16 before the rotation speed of the motor 3 becomes equal to or less than NH2. Even when transition from an actual load state to a non-load state is performed at time t18 (even when the tip tool 10 transitions from an operating state to a non-operating state), the controller 106 maintains the motor 3 at the normal rotation speed NH1. When the trigger switch 16 is turned off at time t19, the controller 106 decelerates the motor 3 to stop the motor 3.

According to the present embodiment, the following effects can be exhibited.

(1) Since the controller 106 executes a first control to drive the motor 3 at a slow idling rotation speed in a non-operating state after the motor 3 is started and before the tip tool 10 is set to be in an operating state, and to drive the motor 3 at a normal rotation speed higher than a slow idling rotation speed when the tip tool 10 is set to be in an operating state, it is possible to curb unnecessary noise and vibration in a non-operating state from when the motor 3 is started to when an operating state is set.

(2) In control shown in FIG. 3 or in control in a hammer mode shown in FIG. 4, when the trigger switch 16 is turned on again under a predetermined condition (a condition that the rotation speed of the motor 3 is not equal to or less than a predetermined rotation speed threshold value) after the trigger switch 16 is turned off in a state where the motor 3 is driven at a normal rotation speed, the controller 106 executes a second control to drive the motor 3 again at a normal rotation speed regardless of the state of the tip tool 10 (whether it is an operating state or a non-operating state), and thus it is possible to reduce a time lag from when the trigger switch 16 is turned on again to when the rotation speed of the motor 3 reaches a normal rotation speed (actual work rotation speed) and to improve the efficiency of work. The predetermined condition may be a condition that a predetermined period of time has not elapsed from when the trigger switch 16 was turned off, or may be a condition that it is after the trigger switch 16 is turned off in a state where a load (motor current) applied to the motor 3 is equal to or greater than a second setting value, or may be a condition that it is after turning on and turning off of the trigger switch 16 being repeated, or may be a condition that any one or two or more of a plurality of conditions are satisfied. Meanwhile, the second setting value may be equal to a first setting value for determining whether or not it is an actual load state.

(3) In control shown in FIG. 3 or in control in a hammer mode shown in FIG. 4, the controller 106 drives the motor 3 at a normal rotation speed even when the tip tool 10 is set to be in a non-operating state in a state where the motor 3 is driven at a normal rotation speed, and thus it is possible to curb a reduction in the efficiency of work due to the rotation speed of the motor being set to be a slow idling rotation speed whenever the tip tool 10 is separated from a work material. Meanwhile, the controller 106 may reduce the rotation speed of the motor 3 to a slow idling rotation speed after a predetermined period of time elapsed after the tip tool 10 is set to be in a non-operating state.

Figure 7:
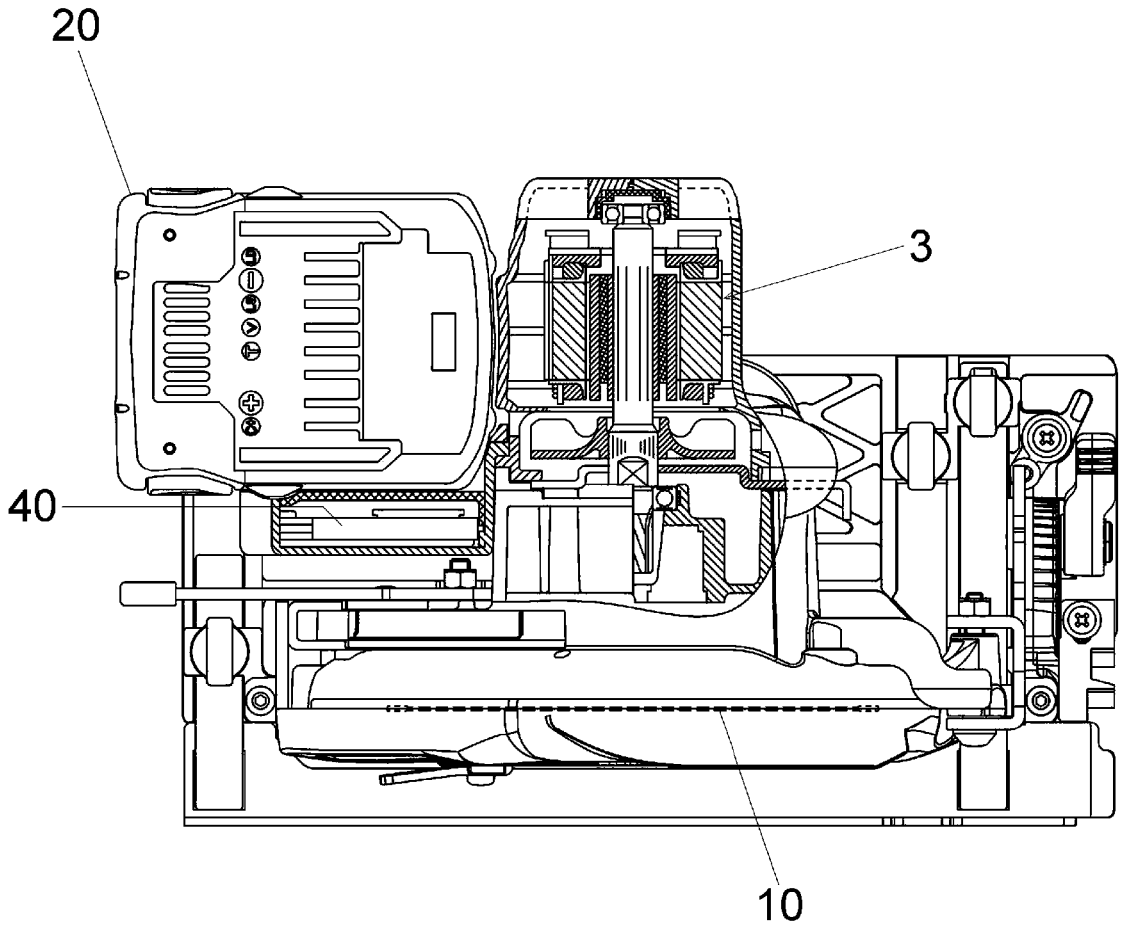
FIG. 7 is a plan cross-sectional view of an electric tool 1A according to another embodiment of the disclosure.

FIG. 7 is a plan cross-sectional view of an electric tool 1A according to another embodiment of the disclosure. The electric tool 1A is a portable circular saw (a portable cutting machine), and a mechanical configuration thereof is the same as that of a cordless circular saw described in Japanese Patent Laid-Open No. 2014-231130. Hereinafter, a brief description will be given as follows. The electric tool 1A includes a battery pack 20 serving as a power supply, a motor (brushless motor) 3, a tip tool (saw blade) 10 which is driven by the motor 3 through a deceleration mechanism not shown in the drawing, a trigger switch not shown in the drawing, and a control circuit board 40 on which a control unit (a controller or the like) controlling the driving of the motor 3 is mounted. The controller provided in the control circuit board 40 performs the same control as that of the controller 106 according to the first embodiment. In the present embodiment, the same effects as those in the first embodiment also can be exhibited.

While the disclosure has been described using the embodiments as examples, one skilled in the art can understand that various modifications can be made to the components and the processing processes in the embodiments without departing from the scope described in claims.

What is claimed is:

1. An electric tool comprising:

a motor;

a tip tool which is driven by the motor;

an operation switch which is operated by an operator; and a control unit which drives the motor when the operation switch is operated, and determines whether the tip tool is in an operating state or a non-operating state by a detection result of a detection unit, wherein the control unit drives the motor at a first rotation speed in response to the tip tool being determined to be in the non-operating state after an operation with the operation switch is started and before the tip tool is determined to be in the operating state, and wherein the control unit drives the motor at a second rotation speed higher than the first rotation speed in response to the tip tool being determined to be in the operating state, and after that, drives the motor at the second rotation speed regardless of a determined state of the tip tool in a case where a predetermined condition, which is fulfilled only by re-operation of the operation switch, is fulfilled after the operation for the operation switch is released in a state where the motor is driven at the second rotation speed and before the motor stops driving.

2. The electric tool according to claim 1, wherein the the detection unit detects a load to be applied to the motor, wherein the control unit determines that the tip tool is in the non-operating state in response to the load detected by the detection unit being less than a first setting value and determines that the tip tool is in the operating state in response to the load being equal to or greater than the first setting value.

3. The electric tool according to claim 1, wherein the predetermined condition is a condition that a rotation speed of the motor is not equal to a predetermined rotation speed or not less than a predetermined rotation speed.

4. The electric tool according to claim 1, wherein the predetermined condition is a condition that a predetermined period of time has not elapsed since the operation is released.

5. The electric tool according to claim 1, wherein the predetermined condition is a condition after the operation is released in a state where a load to be applied to the motor is equal to or greater than a second setting value.

6. The electric tool according to claim 1, wherein the predetermined condition is a condition after the operation with the operation switch and the operation released are repeated.

7. The electric tool according to claim 1, wherein when the motor is driven at the second rotation speed, the control unit drives the motor at the second rotation speed for at least a predetermined period of time even when the tip tool is set to be in the non-operating state.

8. The electric tool according to claim 1, further comprising:

a movement transmission mechanism which is capable of transmitting a rotating force and a striking force to the tip tool through a driving force of the motor; and a switching mechanism which switches to drive the tip tool in any mode of a plurality of modes including at least a striking mode and a rotation striking mode.

9. The electric tool according to claim 8, wherein the control unit drives the motor at the second rotation speed regardless of the determined state of the tip tool only when the switching mechanism selects the striking mode.

10. The electric tool according to claim 8, wherein the control unit drives the motor at the first rotation speed in a case where the operation switch is operated again when a mode selected is switched by the switching mechanism before the motor is stopped after the operation is released.

11. The electric tool according to claim 1, wherein the operation switch is a trigger switch.

12. The electric tool according to claim 1, wherein the motor is a brushless motor.

13. An electric tool comprising:

a motor;

a tip tool which is driven by the motor;

a trigger switch which is operated by an operator; and a control unit which drives the motor when the trigger switch is operated, and determines whether the tip tool is in an operating state or a non-operating state by a detection result of a detection unit, wherein the control unit is capable of executing a first control and a second control, the first control is to drive the motor at a first rotation speed in response to the tip tool being determined to be in a non-operating state after an operation with the trigger switch is started and before the tip tool is set to be in an operating state, and to drive the motor at a second rotation speed higher than the first rotation speed in response to the tip tool being determined to be in the operating state, and the second control is to drive the motor at the second rotation speed regardless of a determined state of the tip tool under a predetermined condition which is fulfilled only by operation of the trigger switch after the operation for the trigger switch is released in a state where the motor is driven at the second rotation speed.

* * * * *